United States Patent [19]

Tanabe

[11] Patent Number: 4,463,238

[45] **Date of Patent: * Jul. 31, 1984**

[54] COMBINED MICROWAVE AND ELECTRIC HEATING OVEN SELECTIVELY CONTROLLED BY GAS SENSOR OUTPUT AND THERMISTOR OUTPUT

[75] Inventor: Takeshi Tanabe, Higashiosaka, Japan

[73] Assignee: Sharp Kabushiki Kaisha, Osaka, Japan

[ * ] Notice: The portion of the term of this patent subsequent to Apr. 13, 1999 has been disclaimed.

[21] Appl. No.: 359,128

[22] Filed: Mar. 17, 1982

Related U.S. Application Data

[63] Continuation of Ser. No. 127,852, Mar. 6, 1980, abandoned.

[30] Foreign Application Priority Data

Mar. 6, 1979 [JP] Japan ..... 54-26404

[51] Int. Cl.[3] ..... H05B 6/68

[52] U.S. Cl. ..... 219/10.55 B; 219/10.55 R

[58] Field of Search ..... 219/10.55 B, 10.55 R, 219/10.55 E, 10.55 M, 400

[56] References Cited

U.S. PATENT DOCUMENTS

| | | | |
|---|---|---|---|
| 3,195,013 | 7/1965 | Thal, Jr. | 219/10.55 B X |
| 3,281,568 | 10/1966 | Haagensen | 219/10.55 B |
| 3,569,656 | 3/1971 | White et al. | 219/10.55 B |
| 4,097,707 | 6/1978 | Kobayashi et al. | 219/10.55 B |
| 4,133,995 | 1/1979 | Buck | 219/10.55 B X |
| 4,162,381 | 7/1979 | Buck | 219/10.55 B |
| 4,308,444 | 12/1981 | Takagi et al. | 219/10.55 R X |
| 4,324,966 | 4/1982 | Tanabe | 219/10.55 B |

FOREIGN PATENT DOCUMENTS

| | | | |
|---|---|---|---|
| 52-13150 | 2/1977 | Japan | 219/10.55 B |
| 53-20142 | 2/1978 | Japan | 219/10.55 B |
| 54-123748 | 9/1979 | Japan | 219/10.55 B |

*Primary Examiner*—B. A. Reynolds
*Assistant Examiner*—Philip H. Leung
*Attorney, Agent, or Firm*—Birch, Stewart, Kolasch & Birch

[57] ABSTRACT

A combined microwave and electric heating oven includes a magnetron for microwave cooking purposes, and a heater for electric heating cooking purposes. A gas sensor is disposed in an exhaustion duct for detecting concentration of a gas developed from an oven cavity, and a thermistor is secured to an oven wall for detecting an air temperature within the oven cavity. A programmed automatic cooking control system is provided for first activating the magnetron. When the gas sensor output reaches a preselected value, the magnetron energization is terminated and, then, the heater is energized. Power supply to the heater is controlled in response to an output signal derived from the thermistor.

11 Claims, 6 Drawing Figures

COMBINED MICROWAVE AND ELECTRIC HEATING OVEN SELECTIVELY CONTROLLED BY GAS SENSOR OUTPUT AND THERMISTOR OUTPUT

This application is a continuation of copending application Ser. No. 127,852, filed on Mar. 6, 1980, now abandoned.

BACKGROUND AND SUMMARY OF THE INVENTION

The present invention relates to a combined microwave and electric heating oven and, more particularly, to a cooking operation control system for the combined microwave and electric heating oven.

A combined microwave and electric heating oven has been developed, which includes a magnetron for microwave cooking purposes and an electric heater for electric heating cooking purposes. However, such a magnetron and an electric heater can not be energized at a same time due to power capacity limitations. For a particular kind of menu, for example, stew, it is preferable that the microwave cooking is first conducted and, then, the electric heating cooking is performed. For another kind of menu, for example, cookies, it is preferable that the electric heating cooking is first conducted and, then, the microwave cooking is performed.

On the other hand, various sensors have been developed for automatic cooking control purposes. A microwave oven is proposed in my copending application Ser. No. 71,179, "COOKING UTENSIL CONTROLLED BY GAS SENSOR OUTPUT", filed on Aug. 31, 1979, now U.S. Pat. No. 4,311,895 wherein a gas sensor is disposed in an exhaustion duct for detecting a gas concentration developed from an oven cavity. When the gas concentration reaches a preselected value, the gas sensor output shows a preselected value, and in response thereto the microwave generation is terminated. And, a thermistor is well known for detecting a cooking temperature.

Accordingly, an object of the present invention is to provide an automatic cooking operation control system for a combined microwave and electric heating oven.

Another object of the present invention is to provide a cooking operation system which selectively responds to a gas sensor output and a thermistor output in a combined microwave and electric heating oven.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a gas sensor is disposed in an exhaustion duct for detecting the concentration of gas developed from an oven cavity, and a thermistor is disposed in the oven cavity for detecting the ambience air temperature within the oven cavity. When, for example, the stew menu is selected by the operator, the microwave cooking is first conducted, wherein the magnetron is deenergized when the gas sensor output shows a preselected value. After completion of the microwave cooking, the electric heating cooking is performed for a preselected period of time, wherein the electric heater is intermittently energized in response to the thermistor output signal.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
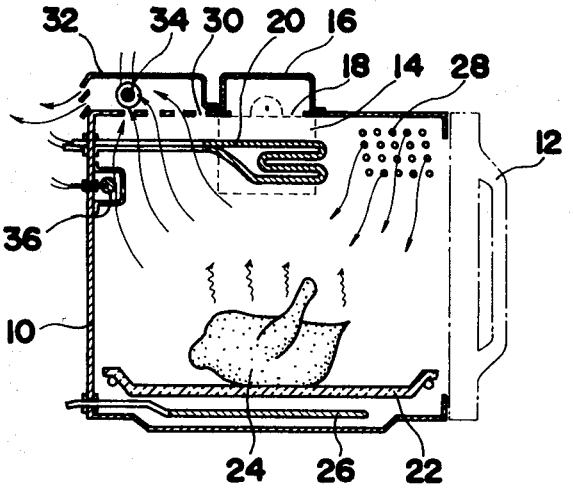
FIG. 1 is a sectional view of an embodiment of a combined microwave and electric heating oven of the present invention.

FIG. 1 shows an embodiment of a combined microwave and electric heating oven of the present invention.

The combined microwave and electric heating oven of FIG. 1 mainly comprises an oven wall 10 for defining an oven cavity, and an oven door 12. A magnetron 14 is secured to the oven wall 10 for supplying the microwave energy into the oven cavity through a wave guide 16 and an energy supply outlet 18. A tray 22 is disposed at the bottom of the oven cavity for supporting a foodstuff 24 to be cooked in the oven cavity. A blower fan is provided to cool the magnetron 14. The air flow generated by the blower fan is introduced into the oven cavity through an air inlet 28. The thus introduced air is exhausted from the oven cavity through exhaustion openings 30 which are formed in the upper wall of the oven cavity. An exhaustion duct 32 is secured to the upper wall of the oven cavity to cover the exhaustion openings 30. A gas sensor 34 is secured to the exhaustion duct 32 for detecting the concentration of the gas exhausted from the oven cavity.

The combined microwave and electric heating oven of FIG. 1 further comprises an upper heater 20, and a lower heater 26 for electric heating cooking purposes. A thermistor 36 is secured to the oven wall 10 for detecting the temperature within the oven cavity.

Figure 2:
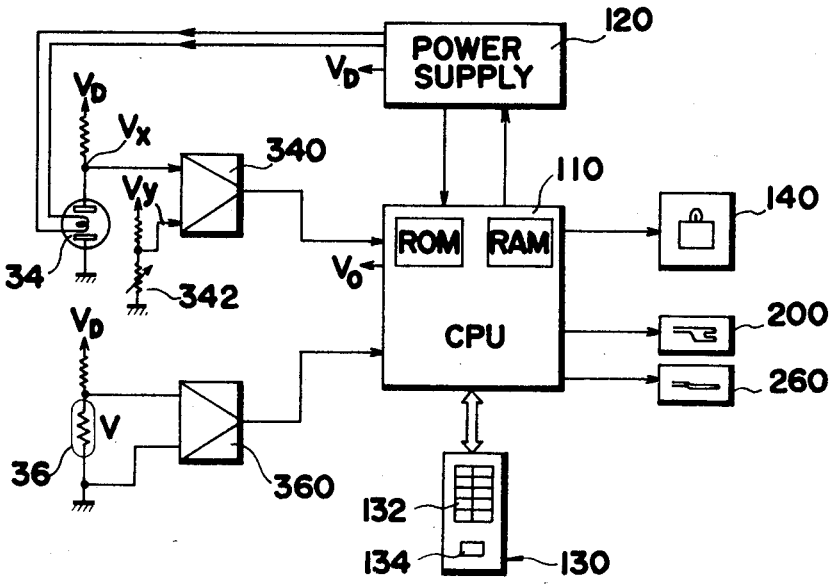
FIG. 2 is a schematic block diagram of a control circuit of the combined microwave and electric heating oven of FIG. 1.

FIG. 2 schematically shows a control circuit of the combined microwave and electric heating oven of FIG. 1 are indicated by like numerals.

The control circuit mainly comprises a central processor unit 110 for developing various control signals, a power supply unit 120 for supplying power to elements included in the combined microwave and electric heating oven, and a key input unit 130 for introducing instruction commands into the central processor unit 110. The key input unit 130 includes menu selection switches 132 for selecting a desired menu to be cooked by the combined microwave and electric heating oven, and a cook start switch 134 for initiating the cooking operation. A microwave generation control circuit 140 is responsive to the control signal derived from the central processor unit 110 for activating the magnetron 14. An upper heater control circuit 200 responds to the control signal derived from the central processor unit 110 for energizing the upper heater 20. A lower heater control circuit 260 responds to the control signal derived from the central processor unit 110 for energizing the lower heater 26.

The gas sensor 34 is associated with a comparator 340 for developing a determination output toward the central processor unit 110. More specifically, an output voltage signal $V_x$ of the gas sensor 34 is applied to one input terminal of the comparator 340. The other input terminal of the comparator 340 is connected to receive a reference voltage signal derived from a variable resistor 342. The resistance value of the variable resistor 342 is determined in accordance with the cooking menu selected by the menu selection switches 132. When the output voltage signal $V_x$ reaches the level of the reference voltage signal derived from the variable resistor 342, the comparator 340 develops the determination output. Detailed operation modes of the gas sensor output controlled cooking is described in my copending application Ser. No. 71,179, "COOKING UTENSIL CONTROLLED BY GAS SENSOR OUTPUT", filed on Aug. 31, 1979.

The thermistor 36 is associated with a detection circuit 360 which develops a temperature control signal toward the central processor unit 110. A typical construction of the temperature detection and cooking temperature control system is described in copending application Ser. No. 856,098, "FOOD TEMPERATURE CONTROL IN A MICROWAVE OVEN", filed on Nov. 30, 1977 by Sigeo Matsubara and Tatsuya Tsuda and assigned to the same assignee as the present application.

Figure 3:
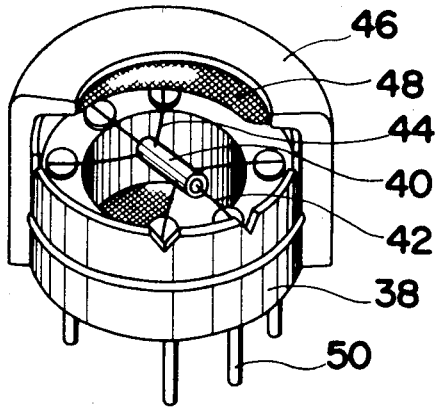
FIG. 3 is a perspective view of an embodiment of a gas sensor included in the combined microwave and electric heating oven of FIG. 1.

FIG. 3 shows an embodiment of the gas sensor 34.

The gas sensor 34 mainly comprises a resin block 38, a sensor 40, a heater coil 42, lead wires 44, a cover 46 including a gauze 48, and an input/output socket 50. A preferred gas sensor is "TGS#813" manufactured by Figaro Engineering Inc.

Figure 4:
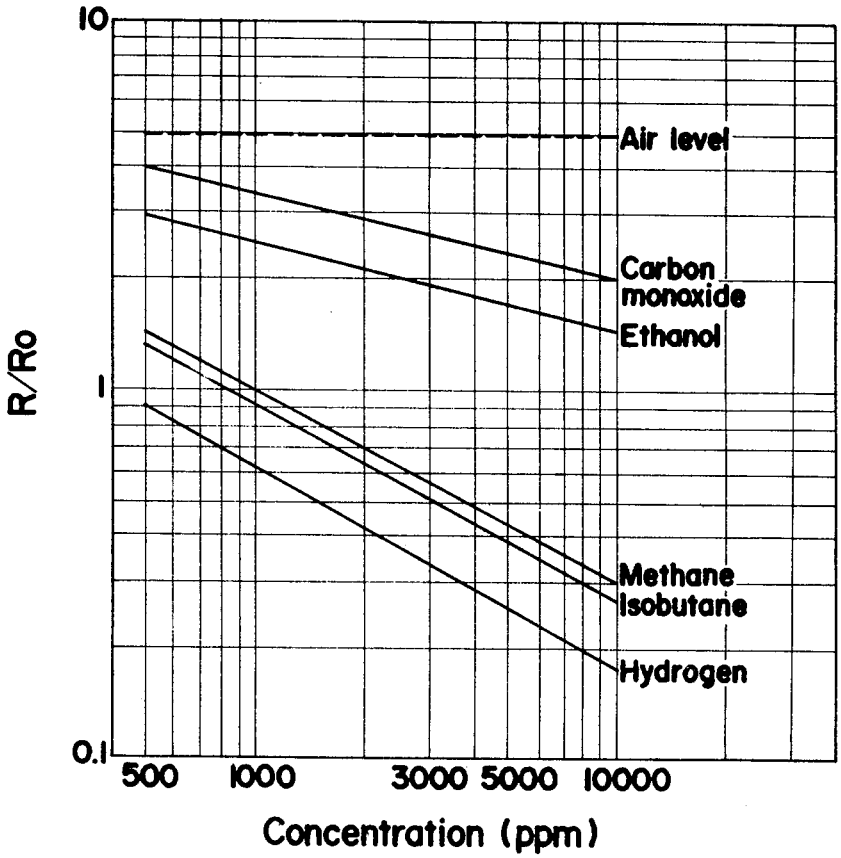
FIG. 4 is a chart showing the gas concentration response characteristic of the gas sensor of FIG. 3.

FIG. 4 shows a relationship between the gas concentration (along the abscissa axis) and the ratio of resistance ($R/R_o$) of the sensor (along the ordinate axis), wherein "$R_o$" is the sensor resistance in air conditioning 1000 ppm of methane, and "R" is the sensor resistance at different concentrations of gases.

Figure 5:
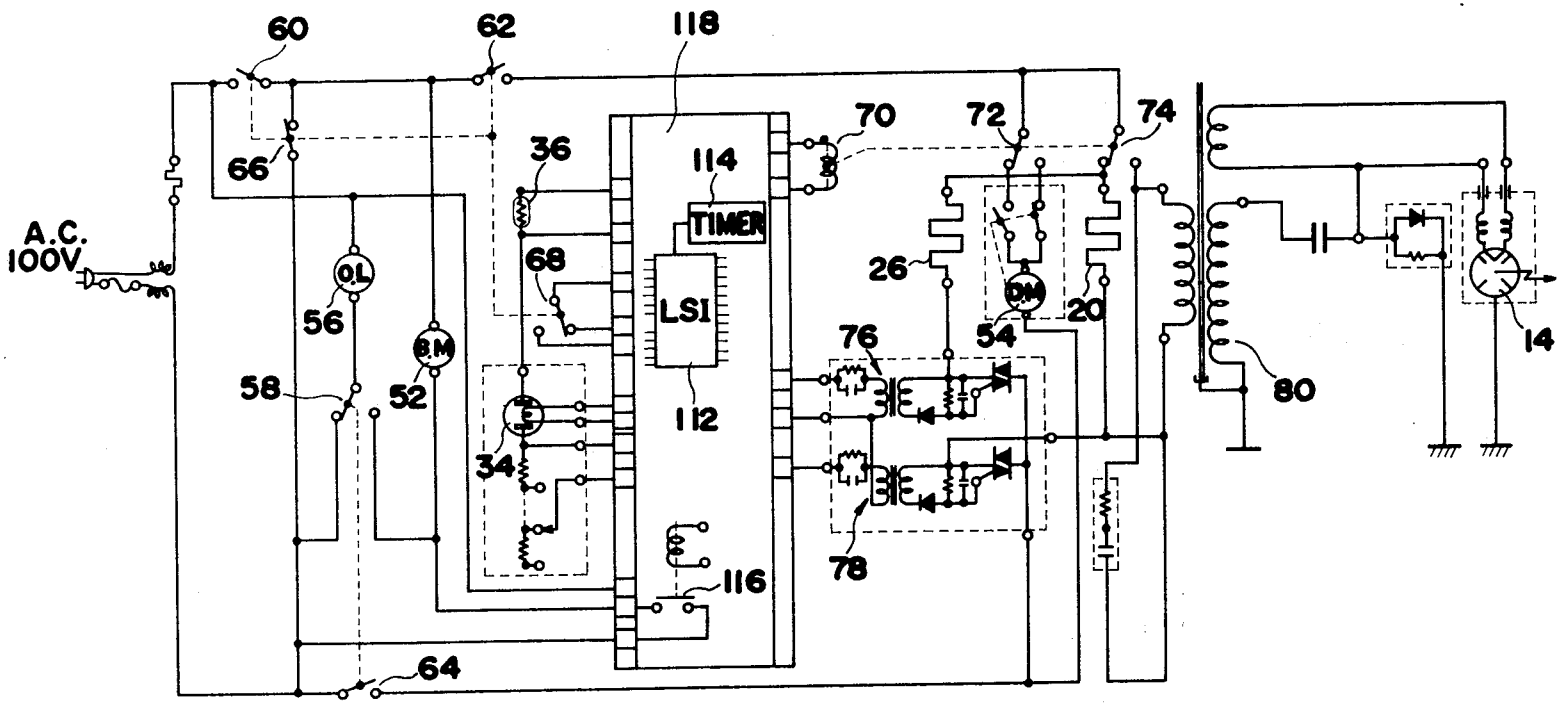
FIG. 5 is a detailed circuit diagram of the control circuit of FIG. 2.

FIG. 5 shows the control circuit of the combined microwave and electric heating oven of FIG. 1 in detail. Like elements corresponding to those of FIGS. 1 and 2 are indicated by like numerals.

The central processor unit 110 (See FIG. 2) mainly comprises an LSI 112 and a timer circuit 114. The LSI 112, the timer circuit 114 and a relay switch 116 are mounted on a control circuit board 118. The combined microwave and electric heating oven of the present invention further comprises a blower motor 52 for activating the blower fan, and a damper motor 54 for activating a damper which controls the air flow within the oven cavity.

Figure 6:
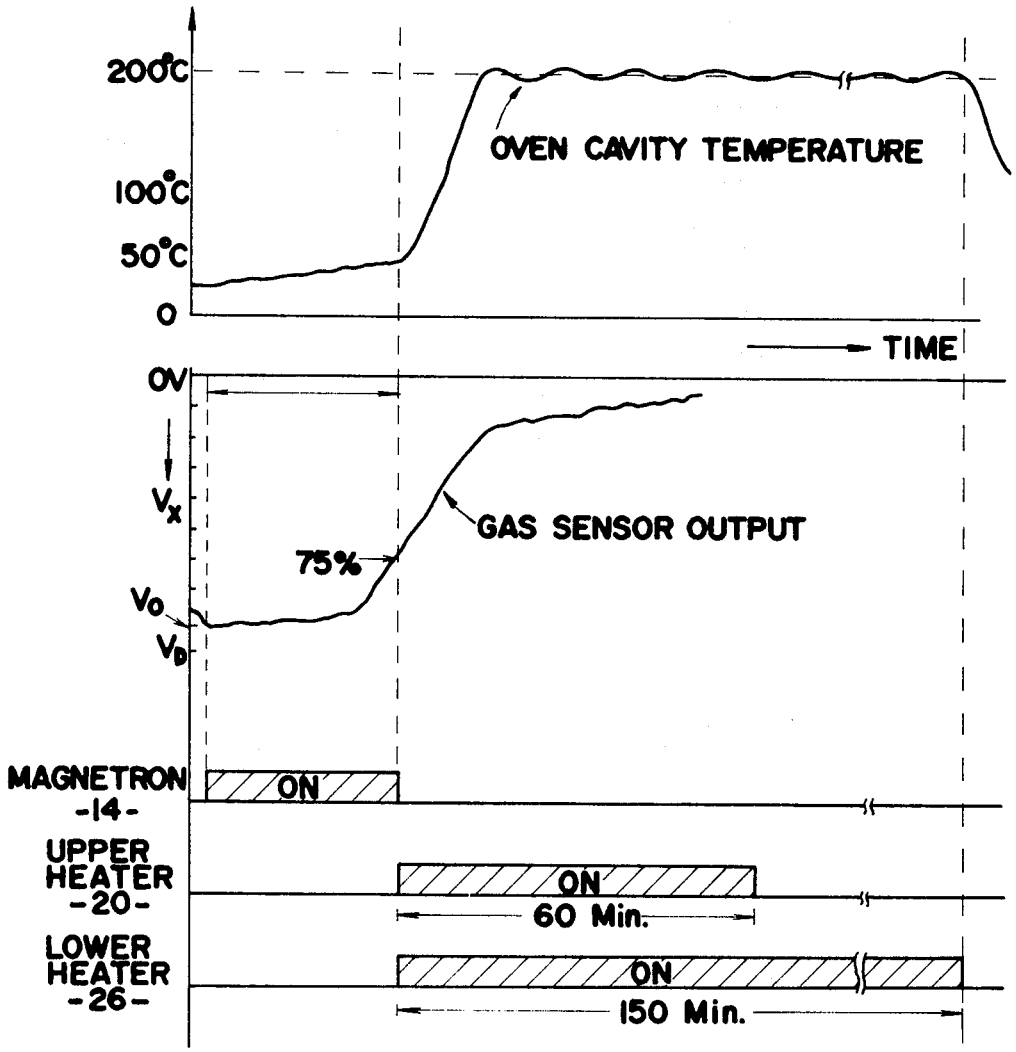
FIG. 6 is a time chart for explaining an operation mode of the combined microwave and electric heating oven of FIG. 1, when a stew menu is selected.

Operation modes of the control circuit of FIG. 5 will be described with reference to the FIG. 6 time chart, wherein the stew menu is selected by the menu selection switch 132.

When the oven door 12 is opened, an oven lamp 56 is supplied with power through a lamp switch 58 to illuminate the interior of the oven cavity. When the oven door 12 is closed, a first latch switch 60, a second latch switch 62 and a door safety switch 64 are switched on, and a monitor switch 66 is switched off, whereby the combined microwave and electric heating oven is placed in a standby condition.

Now assume that the stew menu is selected by the menu selection switch 132 and, then the cook start switch 134 is actuated. In the stew menu, the following cooking operation is automatically conducted by the control circuit.

(1) FIRST PROGRAM

The microwave cooking is first conducted at the duty 100% until the gas sensor 34 shows that the gas concentration has reached a preselected value. In the stew menu, the microwave generation is terminated when the gas sensor output voltage $V_x$ is reduced to 75% of the initial output level.

(2) SECOND PROGRAM

The upper heater 20 and the lower heater 26 are both energized to maintain the oven cavity temperature at around 200° C. for sixty (60) minutes.

(3) THIRD PROGRAM

The lower heater 26 is only energized to maintain the oven cavity temperature at around 200° C. for ninety (90) minutes.

More specifically, when the cook start switch 134 is actuated, the relay switch 116 is switched on to energize the blower motor 52. A selection relay 70 operates selection switches 72 and 74 so that the damper motor 54 is energized to open the damper, and a transformer 80 is energized to activate the magnetron 14. The blower motor 52 activates the blower fan to cool the magnetron. The air flow created by the blower fan is introduced into the oven cavity since the damper is opened. At this moment a second triac circuit 78 is operated to control the power supply to the magnetron 14 via the transformer 80. An interruption switch 68 is provided for suddenly terminating the microwave cooking operation when the oven door 12 is erroneously opened while the microwave cooking is actually conducted.

Under the thus performed microwave cooking operation, when the gas concentration detected by the gas sensor 34 reaches a preselected value, the selection relay 70 is operated to switch the selection switches 72 and 74. The damper is closed so that the air flow is not introduced into the oven cavity. The upper heater 20 is energized through the selection switch 74 and the second triac circuit 78, and the lower heater 26 is energized through the selection switch 74 and a first triac circuit 76. Of course, the microwave generation from the magnetron 14 is terminated because the transformer 80 does not receive the power supply. The first and second triac circuits 76 and 78 are controlled in response to an output signal derived from the thermistor 36, whereby the upper and lower heaters 20 and 26 are energized to maintain the oven cavity temperature at around 200° C.

When sixty (60) minutes have been counted by the timer circuit 114 after initiation of the electric heating cooking operation, the second triac circuit 78 is switched off, whereby only the lower heater 26 is supplied with power.

When additional ninety (90) minutes have been counted by the timer circuit 114, the first triac circuit 76 is also switched off to complete the stew menu.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A combined microwave and electric heating oven comprising:

an oven cavity;

microwave generation source means for supplying microwave energy into said oven cavity for microwave cooking purposes;

electric heater means for electrically heating the ambience within said oven cavity;

a timer system for setting a predetermined period of time gas sensor means for detecting a concentration of a reducing gas exhausted from said oven cavity and for developing a detection output signal in response thereto;

temperature detection means for detecting the cooking temperature and developing an output signal in response thereto; and a control circuit for energizing said microwave generating source means and said electric heater means, said control circuit comprising:

first control means for conducting a first mode of cooking operation by energizing said microwave generation source means, said gas sensor means detecting the cooking condition during said first mode of cooking operation, said first control means terminating the first mode of cooking operation in response to said detection output signal from said gas sensor means;

second control means responsive to the termination of the first mode of cooking operation for initating a second mode of cooking operation by energizing said electric heater means, said temperature detection means detecting the cooking condition during the second mode of cooking operation and generating an output signal for maintaining the oven temperature at a desired value, said second mode for cooking operation being terminated after said predetermined period of time.

2. The combined microwave and electric heating oven of claim 1, wherein said electric heater means comprises:

an upper heater disposed in an upper section of said oven cavity; and a lower heater disposed in a lower section of said oven cavity.

3. The combined microwave and electric heating oven of claim 2, wherein said second control means comprises:

a first switching means for activating both of the upper and lower heaters; and a second switching means for activating only said lower heater.

4. The combined microwave and electric heating oven of claim 1, further comprising a blower fan system for cooling said microwave generation source means.

5. The combined microwave and electric heating oven of claim 4, further comprising a damper system for selectively introducing an air flow created by said blower fan system into said oven cavity, said damper system being opened to introduce the air flow into said oven cavity when said first mode of cooking operation is conducted, said damper system being closed thereby terminating the introduction of the air flow into said oven cavity when said second mode of cooking operation is conducted.

6. The combined microwave and electric heating oven of claim 1, 2, 3, 4 or 5, wherein said temperature detection means comprises a thermistor secured to an oven wall for detecting an air temperature in said oven cavity.

7. The combined microwave and electric heating oven of claim 1, 2, 3, 4 or 5, wherein said control circuit first activates said first control means to first perform said first mode of cooking operation, said control circuit activity said second control means to perform said second mode of cooking operation after completion of said first mode of cooking operation.

8. A combined microwave and electric heating oven, comprising:

an upper electric heater means disposed in an upper portion of the oven cavity of said oven;

a lower electric heater means disposed in a lower portion of the oven cavity;

microwave generation source means for developing microwave energy and directing said microwave energy into said oven cavity;

temperature detection means disposed in said oven cavity for detecting the cooking temperature of a foodstuff placed therein and for developing an output signal in response thereto;

gas sensor means disposed adjacent an exhaustion duct of said oven cavity for detecting the concentration of a reducing gas emitted from said foodstuff and for developing an output signal in response thereto;

control circuit means connected to said upper and lower electric heater means, to said microwave generation source means, to said gas sensor means and to said temperature detection means for energizing said microwave generation source means thereby developing said microwave energy, said control circuit means terminating the energization of said microwave generation source means in response to the output signal from said gas sensor means, said control circuit means energizing said upper and lower electric heater means following the termination of the energization of said microwave generation source means and controlling the energization of said upper and lower electric heater means in response to said output signal from said temperature detection means and timer means for maintaining a count of the elapsed time since energization of said upper and lower heater means, said control means energizing said upper heater means following the termination of the energization of said microwave generation source means and terminating the energization of said upper heater means after the lapse of a first period of time in response to an output signal from said timer means, said control circuit means energizing said lower heater means following the termination of the energization of said upper heater means and terminating the energization of said lower heater means after the lapse of a second period of time in response to an output signal from said timer means.

9. A combined microwave and electric heating oven comprising:

an oven cavity;

microwave generation source means for supplying microwave energy into said oven cavity for microwave cooking purposes;

electric heater means for electrically heating the ambience within said oven cavity;

gas sensor means for detecting a concentration of a reducing gas exhausted from said cavity and for developing a detection output signal in response thereto;

temperature detection means for detecting the cooking temperature and developing an output signal in response thereto; and a control circuit for energizing said microwave generation source means and said electric heater means, said control circuit comprising:

first control means for conducting a first mode of cooking operation by energizing electric heater means, said temperature detection means generating an output signal for maintaining the oven temperature at a desired value for a predetermined period of time;

a timer system for determining the period of time utilized by the first mode of cooking operation; and second control means responsive to the termination of the first mode of cooking operation for initiating a second mode of cooking operation by energizing said microwave generation source means, said gas sensor means detecting the cooking condition during said second mode of cooking operation, said second control means terminating the second mode of cooking operation in response to said detection output signal from said gas sensor means.

10. The combined microwave and electric heating oven of claim 9 wherein the electric heater means includes an upper heater and a lower heater which are energized individually or in combination.

11. A combined microwave and electric heating oven comprising:

an oven cavity;

microwave generation source means for suppyling microwave energy into said oven cavity for microwave cooking purposes;

electric heater means for electrically heating the ambience within said oven cavity;

gas sensor means for detecting a concentration of a gas exhausted from said oven cavity and for developing a detection output signal in response thereto;

temperature detection means for detecting the cooking temperature and developing an output signal in response thereto; and a control circuit for energizing said microwave generation source means and said electric heater means, said control circuit comprising:

microwave control means for conducting a microwave mode of cooking operation by energizing said microwave generation source means, said gas sensor means detecting the cooking condition during said microwave mode of cooking operation, said microwave control means terminating the microwave mode of cooking operation in response to said detection output signal from said gas sensor means;

electric heater control means for conducting an electric heating mode of cooking operation by energizing said electric heater means, said temperature detecting means detecting the cooking condition during said electric heating mode of cooking operation and generating an output signal for maintaining the oven temperature at a desired value for a predetermined period of time a timer system for determining the period of time utilized by the electric heating mode of the cooking operation, and means for selectively initiating either the microwave control means first or electric heater control means first, depending upon the specific cooking sequence which is desired.

* * * * *